US006098315A

United States Patent [19]

Hoffmann, III

[11] Patent Number: 6,098,315

[45] **Date of Patent: *Aug. 8, 2000**

[54] SELF MOLDING INSOLE INSERT

[75] Inventor: John A. Hoffmann, III, Wichita, Kans.

[73] Assignee: Comfort Technologies, Inc., Wichita, Kans.

[ * ] Notice: Under 35 U.S.C. 154(b), the term of this patent shall be extended for 668 days.

[21] Appl. No.: 08/828,616

[22] Filed: Aug. 29, 1996

Related U.S. Application Data

[63] Continuation of application No. 08/455,407, May 31, 1995, abandoned.

[51] Int. Cl.[7] ..... A43B 7/22; A61F 5/14

[52] U.S. Cl. ..... 36/91; 36/93; 36/44; 36/154

[58] Field of Search ..... 36/91, 93, 88, 36/28, 29, 44, 154, 153

[56] References Cited

U.S. PATENT DOCUMENTS 4,236,268 12/1980 Bradley et al. ..... 12/146 S 4,385,024 5/1983 Tansill ..... 264/223

5,101,580 4/1992 Lyden ..... 36/43

*Primary Examiner*—Ted Kavanaugh

*Attorney, Agent, or Firm*—Clark & Brody

[57] ABSTRACT

An insert for a shoe comprises a pouch having a moldable, thixotropic material and a shell having a catalyst. The shell is capable of being ruptured by massaging the pouch to allow the catalyst to be released from the shell and mixed with the material. A pressure sensitive adhesive is on the bottom of the pouch to secure it to the inner sole of a shoe, and a nylon layer is on the top of the pouch to absorb moisture and provide an aesthetic appearance. In use, the pouch is massaged to mix the catalyst and moldable material and is then placed in a shoe. The user places a foot in the shoe and applies a light weight to the foot so that the pouch assumes the shape of the foot bottom and fills that space between the foot and the shoe. Then, the foot is removed to allow the material to cure. When the material is cured the insert prevents excessive collapse of the foot.

12 Claims, 2 Drawing Sheets

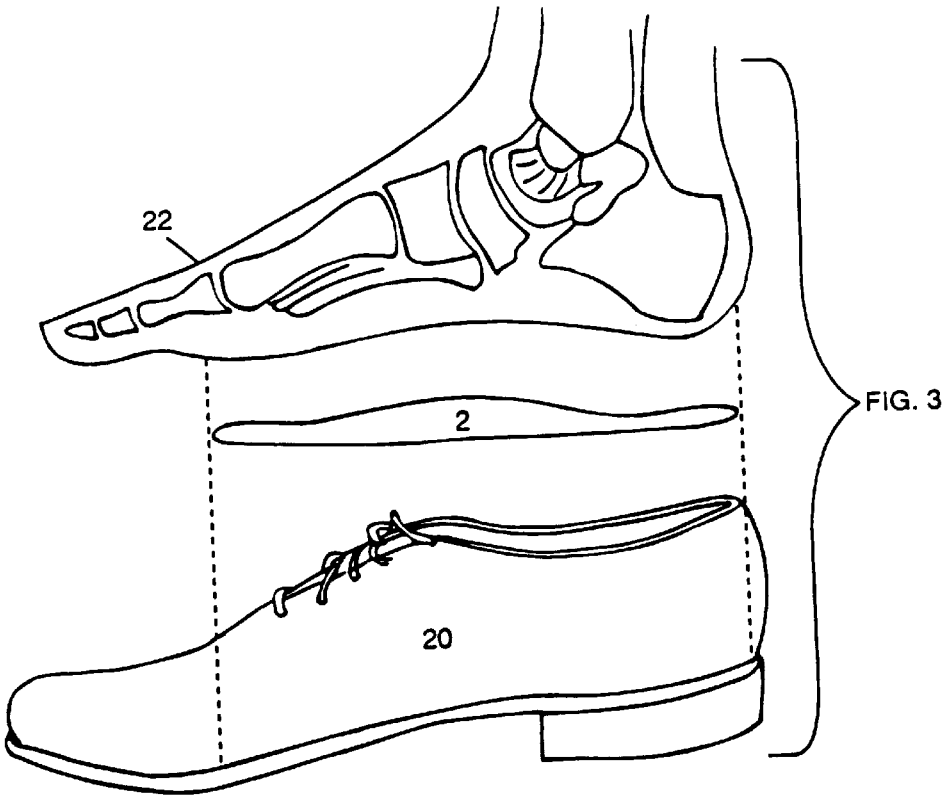
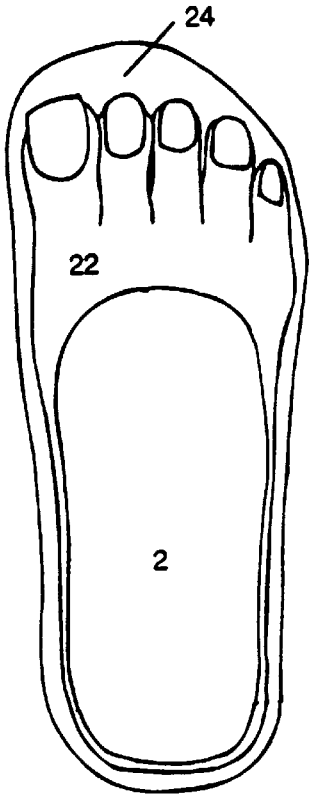
FIG. 4

SELF MOLDING INSOLE INSERT

This is a continuation of U.S. application Ser. No. 08/455,407, filed May 31, 1995 now abandoned.

TECHNICAL FIELD

This invention relates to the art of devices that prevent excessive collapse of a foot. In particular, the invention relates to an insert designed to be placed in a shoe and molded to fit an individual user.

BACKGROUND

Foot pain plagues many persons, and a significant cause of that pain is excessive collapse of the mid-portion of the foot. This collapse is the result of a variety of factors, and several devices have been designed to prevent such collapse. Applicant's prior U.S. Pat. No. 5,129,395, shows one such device. That device is an insert for a shoe that includes surfaces designed to engage the arch of a foot to prevent excessive pronation, or collapse. The requirement that the manufactured, unchangeable surfaces of the device fit against the bottom of feet, with many variations from right to left in the same person and from person to person, by laws of motion, greatly affected results.

SUMMARY OF THE INVENTION

According to the invention, a moldable insert is provided that can be fitted to a variety of shoes by the user alone. The insert comprises a pouch that contains moldable material that is capable of curing to retain its shape. The bottom of the pouch includes an adhesive, which secures the pouch to the inner sole of a shoe and retains it. As a first step, the pouch is placed in the mid-foot region of a shoe. The user then places a foot in the shoe on top of the pouch. Because the material in the pouch is initially moldable, the pouch conforms to the shape of the foot and fills the space between the arch of the foot and the insole of the shoe. The foot is then withdrawn to allow the material in the pouch to cure. After cure, the shoe with the insert may be worn in normal fashion. The cured material in the pouch will support the arch of the foot and prevent excessive collapse of the foot.

In the preferred embodiment, the pouch has several layers. A polyester pouch contains a two-component, synthetic liquid rubber material using a condensation cure catalyst. The compound is preferably a thixotropic material that retains its shape after molding and during cure. A polyester/polyolefin shell in the pouch preferably contains the catalyst. A user can easily rupture the shell by massaging the pouch just before placing the insert in a shoe. A layer of plated nylon is secured to the top of the pouch by a laminate adhesive. This nylon layer absorbs moisture, prevents slipping, and provides an aesthetically pleasing surface that is visible when the shoe is not worn. A pressure sensitive adhesive layer with a removable protective sheet on the bottom of the pouch secures the pouch to the inner sole of the shoe.

To use the insert of the invention, one simply massages the pouch to rupture the inner shell and mix the catalyst with the moldable material. Then, the user removes the protective sheet from the bottom of the insert, and the insert is placed in the mid-foot region of the user's shoe. The user then places a foot in the shoe and places some of his/her weight on the foot. For example, the user can sit in a chair while wearing the shoe. This causes the moldable material to conform very closely to the shape of the foot and fill the space between the bottom of the foot and the insole of the shoe. The user then removes the shoe and allows the material to cure before wearing it again. When the material in the pouch cures, the insert will prevent excessive collapse of the foot by engaging the foot as the arch stretches and preventing it from stretching beyond the shape assumed when placing a small amount of weight on the foot.

The moldable insert of the invention fits the user's foot far better than prior devices because the in situ molding of the insert makes the insert conform even to small variances in the shape of an individual's foot. The support offered by the insert directly addresses the foot's most detrimental short coming. This improves performance of the lower extremity and provides greater stability that results in greater comfort and fewer injuries.

DESCRIPTION OF THE DRAWINGS

FIG. 3 is an exploded view of an insert according to the invention, a shoe, and a user's foot.

FIG. 4 is a top view of the interior of a shoe showing the placement of the insert according to the invention.

DETAILED DESCRIPTION OF THE INVENTION

Figure 1:
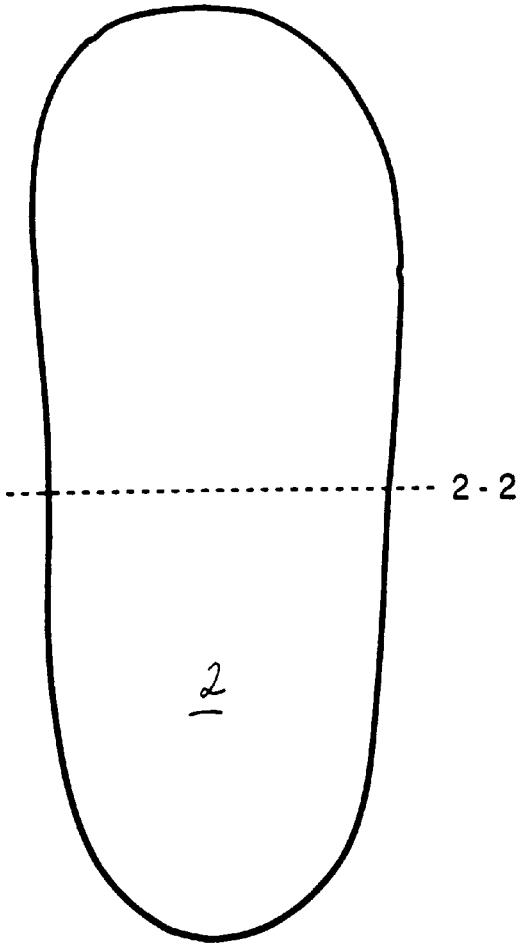
FIG. 1 is a top view of a self molding insert according to the invention.
Figure 2:
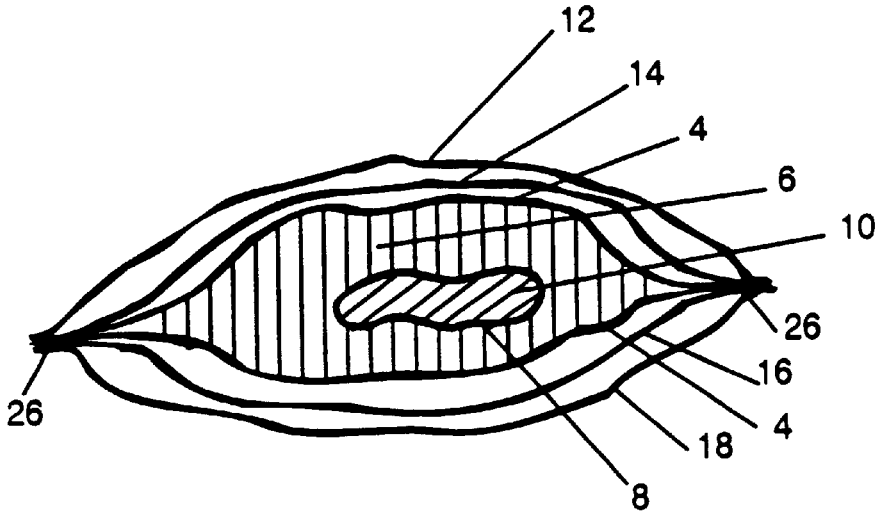
FIG. 2 is a cross section taken along line 2—2 of FIG. 1.

With reference to FIGS. 1 and 2, an insert 2 in accordance with the invention comprises a pouch for being placed in and secured to the interior of a shoe. FIG. 2 is a transverse cross section of the insert and shows its construction in detail. The insert fits the interior of a shoe by extending transversely across the width of the shoe and longitudinally from the heel to the ball of the foot. The insert is, thus, ¾ length. Because of the various sizes of feet, the insert is preferably made in several sizes, e.g., men's, ladies, children. The length of the insert is between 153 mm and 194 mm and the width is from 45 mm to 80 mm. The insert includes a pouch 4 formed by sealing together two sheets of polyester at their edges 26 to form a sealed enclosure. The enclosure of the pouch is filled with a curable material 6. The preferred material is a two component, synthetic liquid rubber material utilizing a condensation cure catalyst, such as that sold by The Dow Corning Corporation under the trade name "HS3." Pouch 4 contains a shell 8, which is made of a polyester/polyolefin material. The shell is easily located by feeling with the fingers and is capable of being ruptured by a gentle massaging action with the fingers. In the preferred embodiment, the material of the shell is formed into an enclosure with a seal, and the seal is ruptured by the massaging. The interior of the shell is filled with a substance 10 that includes a catalyst for curing the moldable material 6 and a thixotropic agent for causing the material 6 to become thixotropic. The catalyst is preferably a condensation cure catalyst. Thus, the user identifies and massages the shell to rupture it, and the substance 10 flows out of the shell to be mixed with the material 6. This provides thixotropic properties to the material and to initiate curing.

The insert also includes a layer 12 of plated nylon, which is secured to the pouch by an adhesive layer 14. The bottom of the pouch has a layer 16 of pressure sensitive adhesive, which is covered before use by a removable protective sheet 18.

FIGS. 3 and 4 illustrate the use of the insert. The user first massages the insert to rupture the shell 8 and to mix the catalyst with the moldable material 6. Then, the user removes the protective sheet 18 and places the insert in a shoe 20 so that it extends generally from the heel portion of the shoe to the ball portion of the shoe and from side-to-side. The insert is maintained in this position by engagement between the inner sole 24 of the shoe and the pressure sensitive adhesive 16. Then, the user inserts a foot 22 into the shoe and places a small amount of weight on the foot. This can be achieved, for example, by wearing the shoe while sitting in a chair with the feet on the floor. This allows the insert to conform to the shape of the bottom of the foot and fill the space formed between the bottom of the foot and the inner sole of the shoe. Then, the user removes the shoe and allows the moldable material to cure. Because the moldable material is thixotropic, it retains the molded shape of the foot after the foot has been removed and during cure.

In the normal gait, a foot contacts the ground and immediately begins to collapse from the heel forward. This downward mid-foot drop causes the bone on the top of the foot (the talus) to rotate, and the leg follows this action. Thus, the foot acts as a spring that gives under the weight of the body, absorbing and redirecting shock. This collapse, or "unlocked phase," continues until the muscles of the foot stop and reverse the downward foot movement. The downward distance varies from person-to-person, or from foot-to-foot, and it is crucial that the downward distance not be so much that the beginning of the upward movement, the "relocking phase," cannot begin on time.

In the abnormal situation, which may include as much as 75% of the population, the collapse continues beyond the point where the foot and leg muscles tighten. This excessive downward foot movement accompanied by the associated, aggravated internal leg rotation, pulls the foot and leg muscles excessively. This causes pain and damage in the form of strains, sprains, and inflammation and forces the timing of the leg muscle contractions into an abnormal sequence. Some examples of damage within the foot associated with this abnormal situation include plantar fasciitis, turf toe, and heel spurs. Leg damage might include shin splints, tendinitis, and stress fractures.

The insert of the invention prevents collapse of the foot by supporting the arch and preventing it from moving beyond the position it was in when the user was placing only a small amount of weight on the foot. Because the pressure sensitive adhesive maintains the position of the insert with respect to the shoe as illustrated in FIG. 4, the results achieved will be consistent.

Modifications within the scope of the appended claims will be apparent to those of skill in the art.

I claim:

1. A self molding supportive insole for a shoe comprising a flexible pouch containing a curable material, means for rendering said material thixotropic whereby when thixotropic said material is moldable, retains its shape after molding and before substantial curing, and is capable of curing to retain its shape for supporting the arch of a foot, and means for curing said moldable material, wherein said pouch is shaped and sized to fit beneath a user's foot in a shoe.

2. Article according to claim 1 further comprising means for securing said pouch to said shoe.

3. Article according to claim 2 wherein said means for securing comprises a pressure sensitive adhesive.

4. Article according to claim 1 further comprising cure containing means within said pouch for containing said means for curing.

5. Article according to claim 4 wherein said cure containing means comprises a shell for releasing said means for curing when ruptured.

6. An article according to claim 5 wherein said shell includes a frangible seal.

7. Article according to claim 1 further comprising a shell within said pouch containing a catalyst for curing and a thixotropic agent for making said material thixotropic, wherein said shell releases said catalyst and thixotropic agent when ruptured.

8. A method for forming a support to prevent excessive mid-foot collapse of a foot comprising placing in a shoe having an inner sole a pouch containing a thixotropic moldable material, said material retaining its shape after molding and before substantial curing and being capable of curing to retain its shape for supporting the arches of a foot, placing said foot in said shoe with said pouch between the bottom of said foot and said inner sole of said shoe, allowing said pouch to assume the shape of the bottom of said foot, removing said foot from said shoe prior to substantial curing of said moldable material, and curing said moldable material.

9. A method according to claim 8 wherein said step of allowing said pouch to assume the shape of the bottom of said foot comprises the step of placing weight on said foot after the step of placing a foot in said shoe and before the step of removing said foot from said shoe.

10. A method according to claim 8 wherein said pouch includes a shell having means for curing said moldable material, and said method further comprises the step of rupturing said shell prior to placing said pouch in said shoe.

11. A method according to claim 10 wherein said shell includes a thixotropic agent for causing said material to become thixotropic.

12. A method for preventing excessive collapse of the arches of a foot comprising placing in a shoe having an inner sole a pouch containing a thixotropic moldable material, which retains its shape after molding and before substantial curing and is capable of curing to retain its shape for supporting the arches of said foot, placing said foot in said shoe such that said pouch is between the arches of said foot and said inner sole of said shoe, placing weight on said foot, removing said foot from said shoe prior to substantial curing of said moldable material, allowing said moldable material to cure, and wearing said shoe with said pouch therein.

* * * * *